US010544913B2

(12) United States Patent
Goelz et al.

(10) Patent No.: US 10,544,913 B2
(45) Date of Patent: Jan. 28, 2020

(54) LED WALL-WASH LIGHT FIXTURE

(71) Applicant: Ideal Industries Lighting LLC, Durham, NC (US)

(72) Inventors: Dave Goelz, Milwaukee, WI (US); John Andre Adams, Cary, NC (US); Zhong Xie, Fishers, IN (US)

(73) Assignee: Ideal Industries Lighting LLC, Durham, NC (US)

( * ) Notice: Subject to any disclaimer, the term of this patent is extended or adjusted under 35 U.S.C. 154(b) by 0 days.

(21) Appl. No.: 15/617,198

(22) Filed: Jun. 8, 2017

(65) Prior Publication Data

US 2018/0356049 A1 Dec. 13, 2018

(51) Int. Cl.

| | |
|---|---|
| ***F21V 7/00*** | (2006.01) |
| ***F21S 8/02*** | (2006.01) |
| *F21V 29/77* | (2015.01) |
| *F21Y 115/10* | (2016.01) |

(52) U.S. Cl.
CPC ..... *F21S 8/026* (2013.01); *F21V 29/77* (2015.01); *F21Y 2115/10* (2016.08)

(58) Field of Classification Search
CPC ..... F21K 9/62; H05B 37/0272; F21S 8/026; F21V 3/00; F21V 29/77; F21V 5/08; F21Y 2113/13; F21Y 2115/10
See application file for complete search history.

(56) References Cited

U.S. PATENT DOCUMENTS

| | | | | |
|---|---|---|---|---|
| 8,118,451 | B2 * | 2/2012 | Householder | F21V 7/0025 362/187 |
| 8,430,523 | B1 * | 4/2013 | Smith | F21V 29/004 362/235 |
| 8,476,836 | B2 | 7/2013 | van de Ven et al. | |
| 8,529,102 | B2 * | 9/2013 | Pickard | F21V 7/0033 362/231 |
| 8,736,186 | B2 | 5/2014 | Chobot | |
| 8,742,671 | B2 | 6/2014 | van de Ven et al. | |
| 8,791,641 | B2 | 7/2014 | van de Ven et al. | |
| 8,810,144 | B2 | 8/2014 | Hu et al. | |
| 8,823,271 | B2 | 9/2014 | van de Ven et al. | |
| 8,829,821 | B2 | 9/2014 | Chobot et al. | |
| 8,912,735 | B2 | 12/2014 | Chobot et al. | |
| 8,975,827 | B2 | 3/2015 | Chobot et al. | |
| 9,101,021 | B2 | 8/2015 | Lys | |
| 9,131,561 | B2 | 9/2015 | Athalye | |
| 9,155,165 | B2 | 10/2015 | Chobot | |
| 9,155,166 | B2 | 10/2015 | Chobot | |
| 9,303,823 | B2 | 4/2016 | Hu et al. | |
| 9,433,061 | B2 | 5/2016 | Chobot | |
| 9,510,413 | B2 | 11/2016 | Athalye et al. | |

(Continued)

OTHER PUBLICATIONS

U.S. Appl. No. 61/932,058, filed Jan. 27, 2014.
U.S. Appl. No. 62/292,528, filed Feb. 8, 2016.

*Primary Examiner* — Donald L Raleigh
(74) *Attorney, Agent, or Firm* — Myers Bigel, P.A.

(57) ABSTRACT

A LED light fixture includes an LED assembly that emits light when energized through an electrical path. An inner optic is positioned to receive the light. The inner optic comprises a lens that emits the light from the inner optic with a wide beam angle. A reflector is positioned to receive the light emitted from the inner optic. An inner reflector is positioned to asymmetrically reflect the light from the inner optic relative to the reflector.

25 Claims, 10 Drawing Sheets

(56) References Cited

U.S. PATENT DOCUMENTS

| | | | | |
|---|---|---|---|---|
| 9,572,226 | B2 | 2/2017 | Motley et al. | |
| 9,622,321 | B2 | 4/2017 | Creasman et al. | |
| 9,681,510 | B2 | 6/2017 | van de Ven | |
| 9,730,289 | B1 | 8/2017 | Hu et al. | |
| 2002/0034078 | A1* | 3/2002 | Natsume | F21S 43/14 362/509 |
| 2009/0168395 | A1* | 7/2009 | Mrakovich | F21S 8/032 362/84 |
| 2009/0231856 | A1* | 9/2009 | Householder | F21V 7/0025 362/304 |
| 2012/0081894 | A1* | 4/2012 | Simon | F21K 9/232 362/235 |
| 2013/0162153 | A1 | 6/2013 | van de Ven et al. | |
| 2013/0223062 | A1* | 8/2013 | Castillo | F21V 13/04 362/235 |
| 2014/0268790 | A1* | 9/2014 | Chobot | F21V 23/0464 362/276 |
| 2015/0312983 | A1 | 10/2015 | Hu et al. | |
| 2015/0351187 | A1 | 12/2015 | McBryde et al. | |
| 2017/0268747 | A1* | 9/2017 | Holder | F21V 13/04 |
| 2018/0067324 | A1* | 3/2018 | Price | F21V 5/002 |

* cited by examiner

LED WALL-WASH LIGHT FIXTURE

BACKGROUND

Light emitting diode (LED) lighting devices are becoming more prevalent as replacements for older lighting systems. LED lighting devices are an example of solid state lighting (SSL) and have advantages over traditional lighting solutions such as incandescent and fluorescent lighting because they use less energy, are more durable, operate longer, can be combined in multi-color arrays that can be controlled to deliver virtually any color light, and generally contain no lead or mercury. A solid-state lighting device may take the form of a lighting unit, light fixture, light bulb, or a lamp.

An LED lighting device may include, for example, a packaged light emitting device including one or more light emitting diodes (LEDs), which may include inorganic LEDs, which may include semiconductor layers forming p-n junctions and/or organic LEDs (OLEDs), which may include organic light emission layers. Light perceived as white or near-white may be generated by a combination of red, green, and blue ("RGB") LEDs. Output color of such a lighting device may be altered by separately adjusting supply of current to the red, green, and blue LEDs. Another method for generating white or near-white light is by using a lumiphor such as a phosphor. Still another approach for producing white light is to stimulate phosphors or dyes of multiple colors with an LED source. Many other approaches can be taken.

LED lighting devices may be used in a variety of applications such as lamps that are replacements for incandescent bulbs, complete light fixtures or the like. Moreover, LED lighting devices may be used to provide a variety of light emission patterns including omnidirectional, spot, directional, indirect or direct lighting or the like.

SUMMARY OF THE INVENTION

In some embodiments a LED light fixture comprises at least one LED operable to emit light when energized through an electrical path. An inner optic is positioned to receive the light where the inner optic comprises a lens for emitting the light from the inner optic. A reflector is positioned to receive the light emitted from the inner optic. An inner reflector is positioned to asymmetrically reflect the light from the inner optic relative to the reflector.

The inner optic may comprise a mixing chamber. The lens may be diffusive. The lens may emit light with a beam angle of between 30 and 65 degrees. The reflector may comprise a first reflective surface and a second reflective surface. The second reflective surface may reflect light asymmetrically relative to the reflector. The inner reflector may be positioned opposite the second reflective surface. The inner reflector may be positioned at least partially over the lens. The inner reflector may cover approximately 40-60% of the lens. The inner reflector may comprise a reflective surface that faces the lens. The inner reflector may comprise a non-reflective outside surface. The inner reflector may reflect light to the second reflective surface. A keyed connection may orient the inner reflector relative to the reflector. The inner reflector may reflect light toward the second reflective surface. The inner reflector may reflect light asymmetrically relative to the reflector. The inner reflector may reflect light asymmetrically toward a bottom of an adjacent surface and the reflector may reflect light asymmetrically toward a top of the adjacent surface.

In some embodiments a LED light fixture comprises at least one LED operable to emit light when energized through an electrical path. An inner optic is positioned to receive the light, the inner optic comprises a lens for emitting the light from the inner optic. A first reflective surface and a second reflective surface are positioned to receive the light emitted from the inner optic. An inner reflector is positioned to reflect a portion of the light from the inner optic toward the second reflective surface.

The lens may be diffusive. The lens may emit light with a beam angle of between 30 and 65 degrees. The inner reflector may be positioned opposite the second reflective surface. The inner reflector may be positioned at least partially over the lens. The inner reflector may cover approximately 40-60% of the lens.

In some embodiments, a LED light fixture comprises at least one LED operable to emit light when powered through an electrical path. An inner optic is positioned to receive the light. The inner optic comprises a reflector and a lens for emitting the light from the inner optic. The lens comprises a first diffusive portion, a second diffusive portion and a transition portion between the first diffusive portion and the second diffusive portion. The first diffusive portion is more diffusive than the second diffusive portion and the transition portion is less diffusive than the first diffusive portion and more diffusive than the second diffusive portion. A reflector is positioned to receive the light emitted from the inner optic. The transition portion may comprise interdigitated diffusive portions. The lens may emit light asymmetrically.

DETAILED DESCRIPTION

Figure 1:
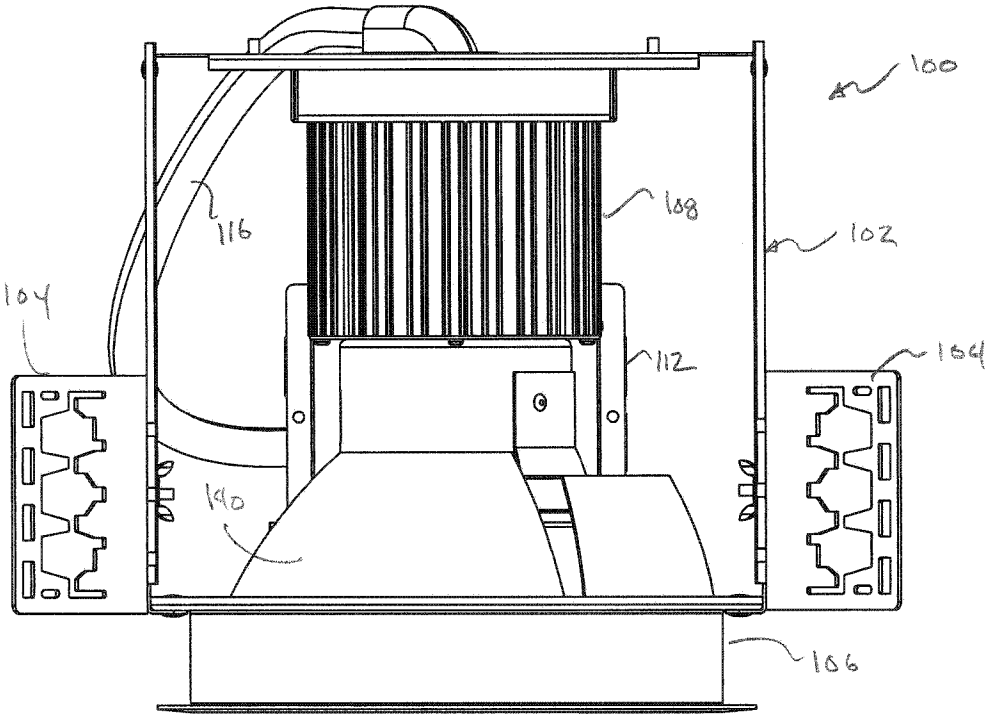
FIG. 1 is a side view of an embodiment of a lighting fixture of the invention.
Figure 2:
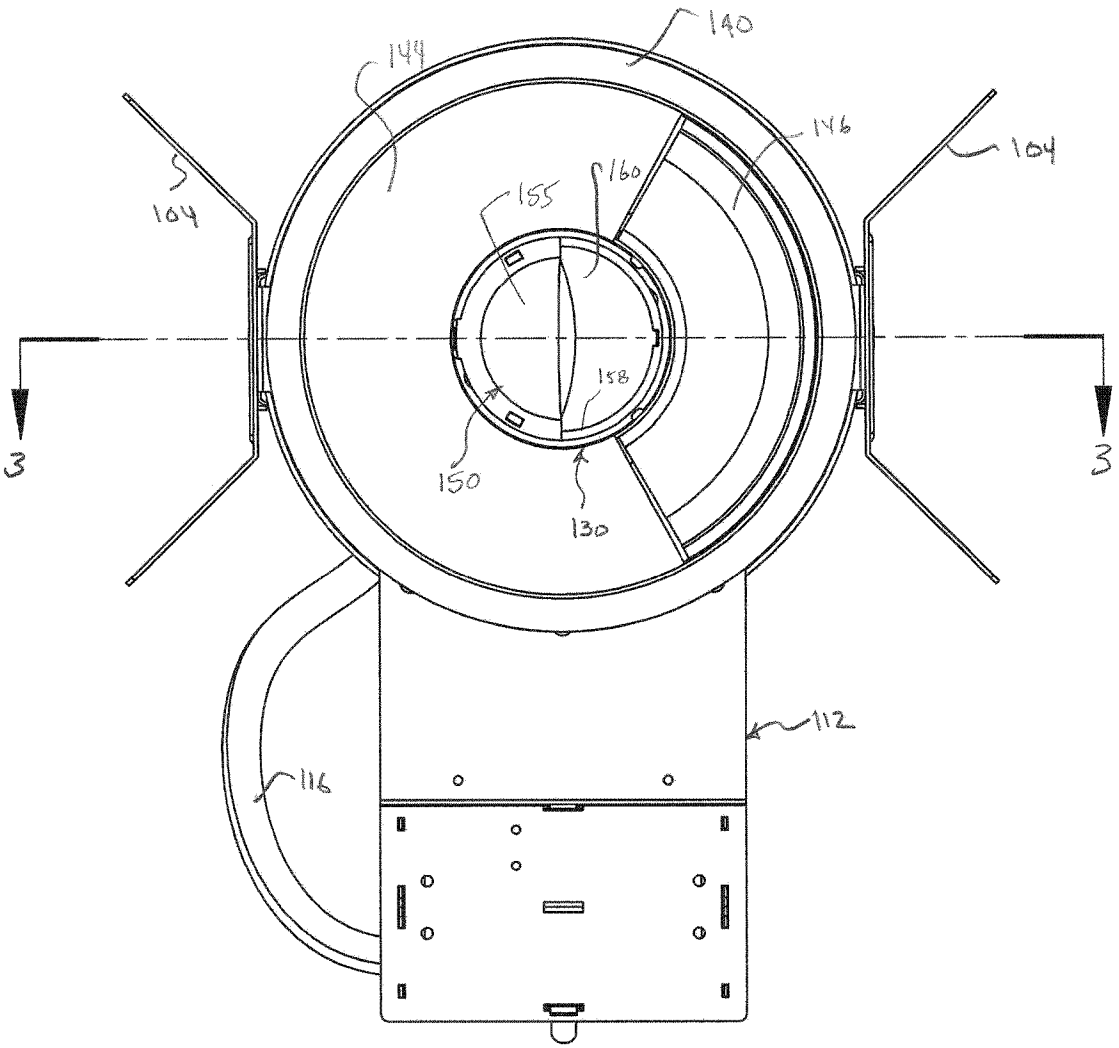
FIG. 2 is a bottom view of the lighting fixture of FIG. 1.
Figure 3:
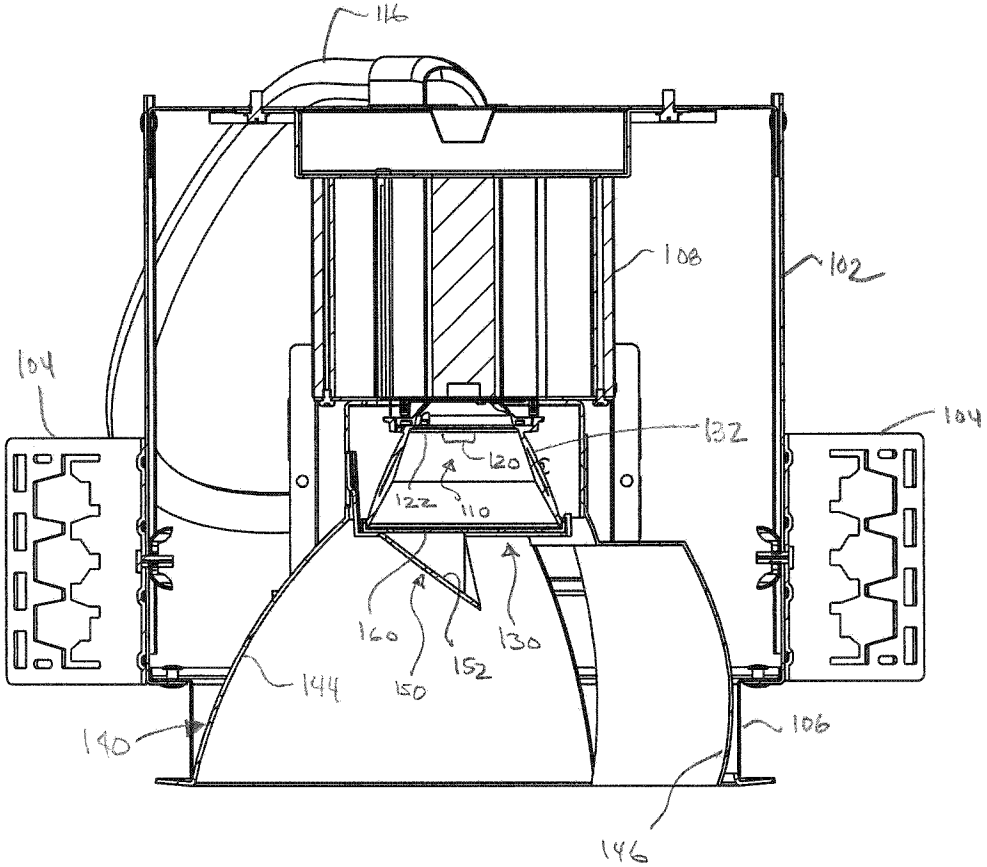
FIG. 3 is a section view taken along line 3-3 of FIG. 2.
Figure 4:
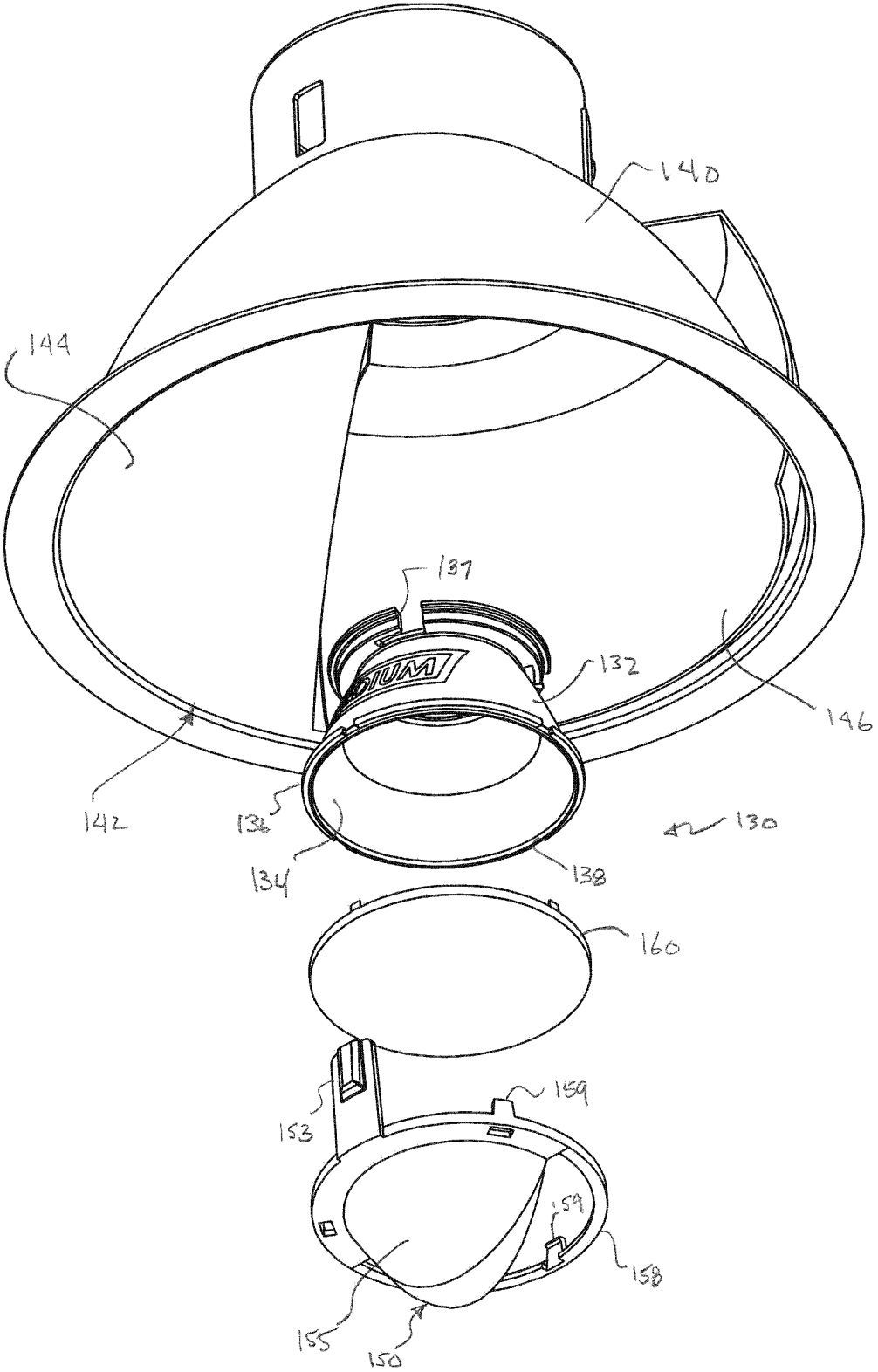
FIG. 4 is an exploded view of the reflectors and inner optic of the lighting fixture of FIG. 1.
Figure 5:
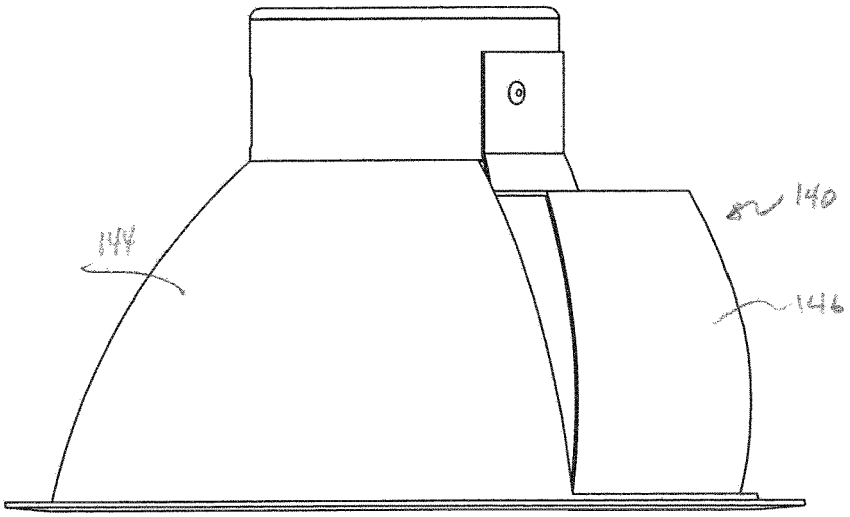
FIG. 5 is a side view of the components of FIG. 4 as assembled.
Figure 6:
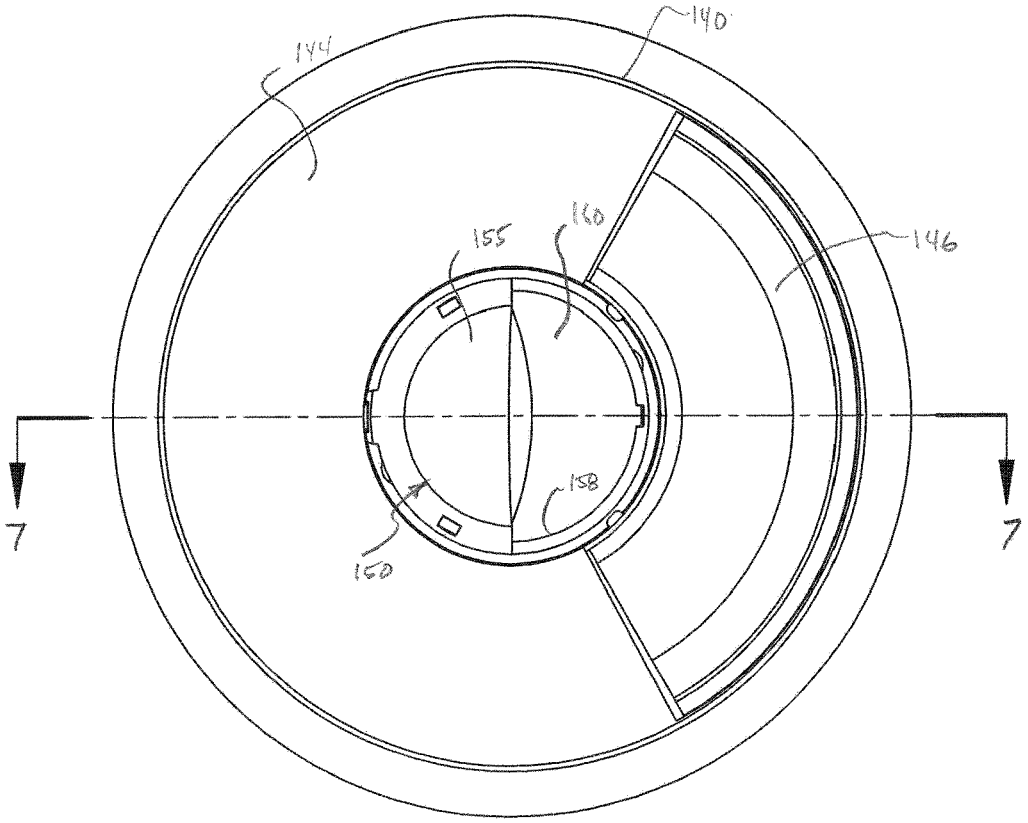
FIG. 6 is a bottom view of the components of FIG. 4 as assembled.
Figure 7:
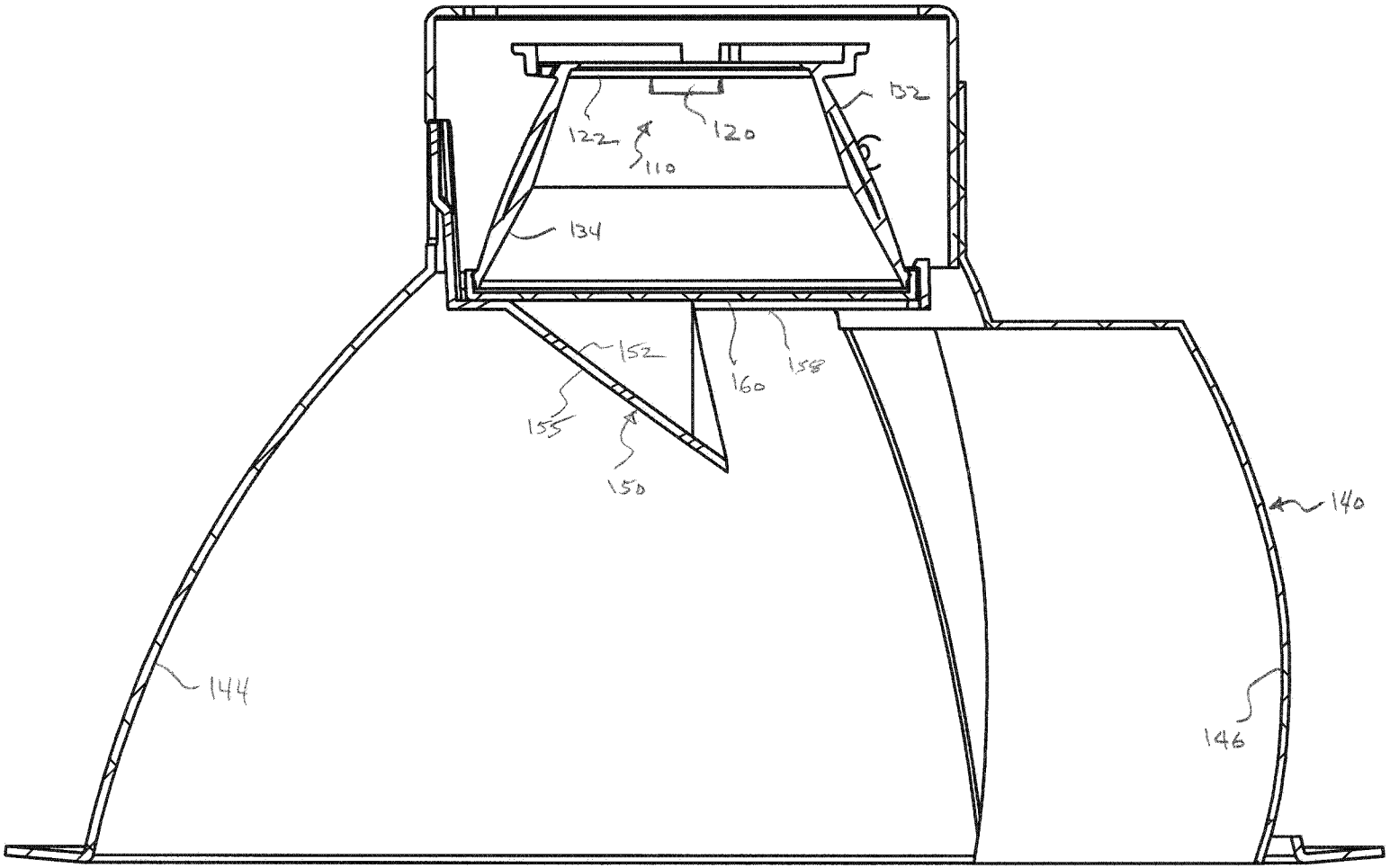
FIG. 7 is a section view taken along line 7-7 of FIG. 6.

Embodiments of the present invention now will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

It will be understood that when an element such as a layer, region or substrate is referred to as being "on" or extending "onto" another element, it can be directly on or extend directly onto the other element or intervening elements may also be present. In contrast, when an element is referred to as being "directly on" or extending "directly onto" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

Relative terms such as "below" or "above" or "upper" or "lower" or "horizontal" or "vertical" or "top" or "bottom" may be used herein to describe a relationship of one element, layer or region to another element, layer or region as illustrated in the figures. It will be understood that these terms are intended to encompass different orientations of the device in addition to the orientation depicted in the figures.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms used herein should be interpreted as having a meaning that is consistent with their meaning in the context of this specification and the relevant art and will not be interpreted in an idealized or overly formal sense unless expressly so defined herein.

Unless otherwise expressly stated, comparative, quantitative terms such as "less" and "greater", are intended to encompass the concept of equality. As an example, "less" can mean not only "less" in the strictest mathematical sense, but also, "less than or equal to."

The terms "LED" and "LED device" as used herein may refer to any solid-state light emitter. The terms "solid state light emitter" or "solid state emitter" may include a light emitting diode, laser diode, organic light emitting diode, and/or other semiconductor device which includes one or more semiconductor layers, which may include silicon, silicon carbide, gallium nitride and/or other semiconductor materials, a substrate which may include sapphire, silicon, silicon carbide and/or other microelectronic substrates, and one or more contact layers which may include metal and/or other conductive materials. A solid-state lighting device produces light (ultraviolet, visible, or infrared) by exciting electrons across the band gap between a conduction band and a valence band of a semiconductor active (light-emitting) layer, with the electron transition generating light at a wavelength that depends on the band gap. Thus, the color (wavelength) of the light emitted by a solid-state emitter depends on the materials of the active layers thereof. In various embodiments, solid-state light emitters may have peak wavelengths in the visible range and/or be used in combination with lumiphoric materials having peak wavelengths in the visible range. Multiple solid state light emitters and/or multiple lumiphoric materials (i.e., in combination with at least one solid state light emitter) may be used in a single device, such as to produce light perceived as white or near white in character. In certain embodiments, the aggregated output of multiple solid-state light emitters and/or lumiphoric materials may generate warm white light output having a color temperature range of from about 2200 K to about 6000 K.

Solid state light emitters may be used individually or in combination with one or more lumiphoric materials (e.g., phosphors, scintillators, lumiphoric inks) and/or optical elements to generate light at a peak wavelength, or of at least one desired perceived color (including combinations of colors that may be perceived as white). Inclusion of lumiphoric (also called 'luminescent') materials in lighting devices as described herein may be accomplished by direct coating on solid state light emitter, adding such materials to encapsulants, adding such materials to lenses, by embedding or dispersing such materials within lumiphor support elements, and/or coating such materials on lumiphor support elements. Other materials, such as light scattering elements (e.g., particles) and/or index matching materials, may be associated with a lumiphor, a lumiphor binding medium, or a lumiphor support element that may be spatially segregated from a solid state emitter.

While one embodiment of a light fixture 100 is shown and described, the invention may be used in any LED lighting device where the benefits of the invention may be realized. Light fixture 100 produces asymmetric light and may be used in so called wall-wash applications. Wall-wash is a lighting technique for illuminating large flat surfaces such as a wall where light is directed onto the surface to illuminate the surface over substantially its entire length, e.g. for a wall the illumination is substantially from floor to ceiling. To achieve this lighting effect the light emitted from the light fixture is projected asymmetrically such that a portion of the light is projected directionally onto the surface to be illuminated. One important consideration for a wall-wash lighting fixture is illumination of the wall uniformly from the ceiling to the floor. Two separate light sources contribute to the uniform illumination of the wall. One is the direct light component which illuminates the area near the floor. Direct light being light emitted from the light fixture directly onto the wall. The other one is the reflected light component generated by light reflected from a kicker reflector which illuminates the area near the ceiling. If the light components from the two light sources are not overlapped correctly, a bright or dark arc of non-uniform light will be visible on the surface at the area of intersection of the light components. Also, the overlapping of the two light components requires a certain tolerance to accommodate situations where the relative positions of each of the light components are not perfectly positioned. This requires that the edges of the two light components are relatively soft because the transition between the two light component swill not be visually acceptable if the two light components have hard edges. The lenses used in the present light fixture diffuse the direct light to create soft edges. Another important consideration for wall-wash is the balance between the two light components. In some configurations, the direct light is much stronger than the reflected light from the kicker. In the lamp of the invention the lens combined with an inner optic reflector diffuses and/or blocks a portion of the light to make the direct light weaker while scattering sufficient light to the kicker to have it reflected to the top of the wall to create balance between the light components. While in a typical application the light fixture is used to illuminate a wall it is to be understood that the light fixture of the invention may be used to illuminate any suitable structure and that reference to a wall, ceiling and floor is used to only explain the operation of the light fixture.

Referring to FIGS. 1-7 in one embodiment the light fixture 100 may include a lamp housing 102 that supports the light fixture in a structure such as a ceiling. In the illustrated embodiment the light fixture 100 is intended to be mounted as a recessed light in a ceiling where the housing 102 includes connection members 104 that are configured to be mounted to ceiling joists or other structure with the support ring 106 disposed in a hole formed in the finished ceiling surface. The housing 102 may be mounted directly to the support structure or intervening support members may be used between the connection members 104 and the support structure. The housing 102 also supports a heat sink structure 108 that is thermally coupled to the LED assembly 110 to dissipate heat from the LEDs. The heat sink structure is made of a thermally conductive material and may include fins or other structure to facilitate dissipation of heat therefrom. Heat may be conducted to the heat sink structure 108, away from the LED assembly 110 and dissipated to the ambient environment.

An electronics housing or circuit box 112 may be supported on or form part of the housing 102 or the electronics housing or circuit box 112 may be a physically separate from the housing. Electronics housing 112 contains the electronics used to drive and control the LEDs that make up LED assembly 110 such as driver circuitry, power supply, rectifiers, regulators, timing circuitry, and other components. Electrical conductors in conduit 116 deliver critical current from the lamp electronics in electronics housing 112 to the LEDs. Power may be supplied to the electronics in electronics housing 112 by a power source such as the electrical power grid of a building to complete the electrical path to the LEDs. The term "electrical path" can be used to refer to the entire electrical path to the LED's, including an intervening power supply disposed between the electrical connection that would otherwise provide power directly to the LEDs and the LED array, or it may be used to refer to the connection between the mains and all the electronics in the lamp, including the power supply. The term may also be used to refer to the connection between the power supply and the LEDs. Electrical conductors run between the LEDs and the lamp electronics to carry both sides of the supply to provide critical current to the LEDs.

The LED assembly 110 comprises least one and typically a plurality of LEDs 120, such as individual LED chips, LED packages or the like, which can be mounted or fixed to collectively define an LED assembly 110 that serves as a light source for the light fixture. The LEDs 120 may be mounted on and electrically coupled to an electrically conductive submount 122 such as a printed circuit board (PCB), metal core printed circuit board (MCPCB), lead frame structure, flex circuit or the like. The submount 122 may be mounted on and is thermally coupled to the heatsink structure 108 to dissipate heat from the LEDs 120.

A multi-chip LED package may be used with embodiments of the invention and can include light emitting diode chips that emit hues of light that, when mixed, are perceived in combination as white light. Phosphors can also be used. Blue or violet LEDs can be used in the LED devices and the appropriate phosphor can be deployed elsewhere within the fixture. LED devices can be used with phosphorized coatings packaged locally with the LEDs to create various colors of light. For example, blue-shifted yellow (BSY) LED devices can be used with a red phosphor on or in a carrier or on the reflector to create substantially white light, or combined with red emitting LED devices on the heatsink to create substantially white light. A lighting system using the combination of BSY and red LED devices referred to above to make substantially white light can be referred to as a BSY plus red or "BSY+R" system. In such a system, the LED devices used include LEDs operable to emit light of two different colors. Such embodiments can produce light with a CRI of at least 70, at least 80, at least 90, or at least 95. A further detailed example of using groups of LEDs emitting light of different wavelengths to produce substantially while light can be found in issued U.S. Pat. No. 7,213,940, which is incorporated by reference herein in its entirety.

As used herein, the term LED may comprise packaged LED chip(s) or unpackaged LED chip(s). LED elements or modules of the same or different types and/or configurations. The LEDs can comprise single or multiple phosphor-converted white and/or color LEDs, and/or bare LED chip(s) mounted separately or together on a single substrate or package that comprises, for example, at least one phosphor-coated LED chip either alone or in combination with at least one color LED chip, such as a green LED, a yellow LED, a red LED, etc. The LED module can comprise phosphor-converted white or color LED chips and/or bare LED chips of the same or different colors mounted directly on a printed circuit board (e.g., chip on board) and/or packaged phosphor-converted white or color LEDs mounted on the printed circuit board, such as a metal core printed circuit board or FR4 board. In some embodiments, the LEDs can be mounted directly to the heat sink or another type of board or substrate. Depending on the embodiment, the lighting device can employ LED arrangements or lighting arrangements using remote phosphor technology as would be understood by one of ordinary skill in the art, and examples of remote phosphor technology are described in U.S. Pat. No. 7,614,759, assigned to the assignee of the present invention and hereby incorporated by reference. In some embodiments, each LED element or module or a plurality of such elements or modules may include one or more blue LEDs with a yellow or green phosphor and one or more blue LEDs with a red phosphor. The LEDs may be disposed in different configurations and/or layouts as desired, for example utilizing single or multiple strings of LEDs where each string of LEDs comprise LED chips in series and/or parallel. Different color temperatures and appearances could be produced using other LED combinations of single and/or multiple LED chips packaged into discrete packages and/or directly mounted to a printed circuit board as a chip-on board arrangement. Other LED arrangements are possible. In some embodiments, a string, a group of LEDs or individual LEDs can comprise different lighting characteristics and by independently controlling a string, a group of LEDs or individual LEDs, characteristics of the overall light out output of the device can be controlled.

The light fixture 100 further comprises an inner optic 130. The inner optic 130 functions to treat the light emitted by the LED assembly 110 to provide color mixing, even intensity and light uniformity and to emit the light in a controlled light distribution pattern such that the emitted light may be reflected in the desired wall-wash pattern. The inner optic 130 comprises a housing 132 that surrounds the LEDs 120 of LED assembly 110. The housing 132 defines a mixing chamber that includes a reflective surface 134 that reflects the light emitted by the LEDs to mix the light and deliver the light to lens 160. The reflective surface 134 may have a generally conical, dome, semi-spherical or parabolic shape. However, in one preferred embodiment the reflector has a faceted reflective surface 134.

Figure 8:
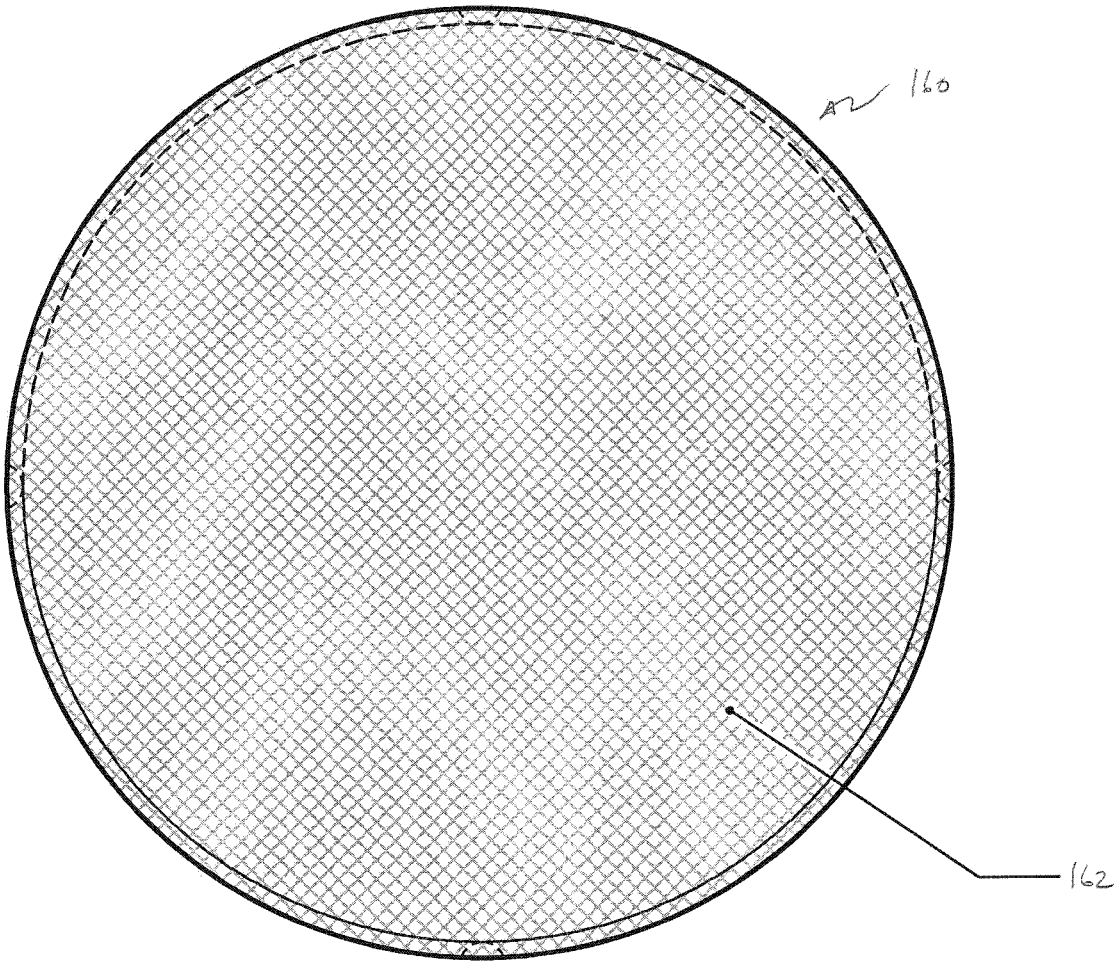
FIG. 8 is a plan view of an embodiment of a lens usable in the lighting fixture of the invention.
Figure 9:
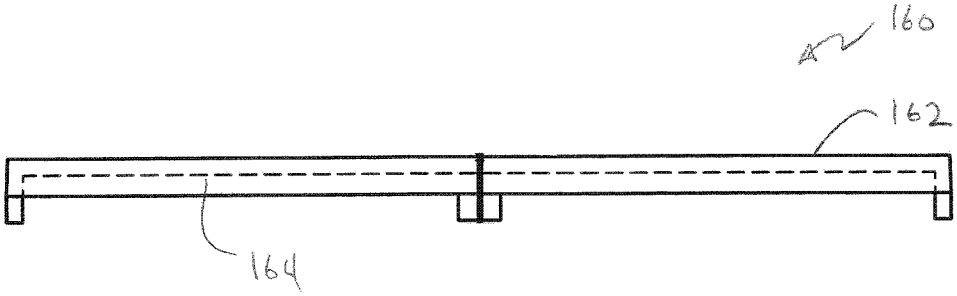
FIG. 9 is a side view of the lens of FIG. 8.
Figure 10:
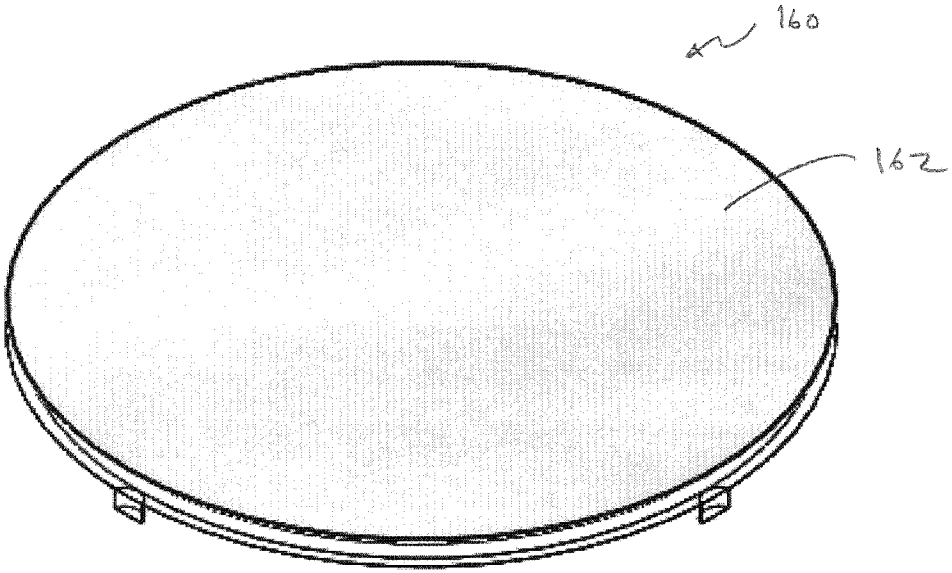
FIG. 10 is a perspective view of the lens of FIG. 8.

Lens 160 covers the exit opening 138 of the housing 132 such that the light is emitted in a controlled manner. In one embodiment the lens comprises a diffusive surface treatment that disperses the light with a wide beam angle. In one embodiment the lens emits light with a beam angle of between 30 and 65 degrees. Referring to FIGS. 8-10 in one embodiment the lens 160 may comprise a substantially flat member having an entrance surface 164 for receiving light from the LEDs and an exit surface 162 for emitting light from the inner optic. The exit surface 162 is formed with as a light diffusive surface to generate the beam angle described above. In one embodiment the lens is formed of ABS PC thermoplastic and the diffusive exit surface 162 may be formed by sandblasting or by molding the texture into the lens. Flanges 166 may extend from the periphery of the lens that deform to snap fit onto the inner reflector 132.

The light fixture further includes a reflector 140 that surrounds the inner optic 130 and that receives the light emitted from the inner optic. The reflector 140 has a reflective surface 142 that includes a first reflective surface 144 and a "kicker" or a second reflective surface 146. The first reflective surface 144 is shaped to reflect light received from the inner optic in a predetermined pattern at a predetermined beam angle to provide generally omnidirectional downlighting. The first reflective surface 144 may have a generally dome shape, semi-spherical shape or parabolic shape. However, other reflector shapes may be used such as conical, truncated cone, truncated dome, semispherical, faceted or the like. Any suitable shape and configuration may be used to achieve the desired beam angle and light distribution pattern. The first reflective surface 144 may reflect the light in a relatively tight pattern or in a wider pattern such as commonly found in PAR- and BR-style lamps.

The second reflective surface 146 reflects light asymmetrically relative to the lamp to create the wall washing effect. The second reflective surface 146 may be contiguous with the first reflective surface 144 or it may be a separate surface as shown in the figures. The second reflective surface 146 has a shape and/or finish that is different than the shape and/or finish of the first reflective surface 144 such that light reflected off of the second reflective surface 146 is reflected directionally. When the light fixture 100 is positioned adjacent a surface such as a wall the light reflected from the second reflective surface 146 combined with light projected onto the wall directly from the inner optic 130 combine to create the wall washing effect. Specifically, light reflected off of the second reflective surface 146 is directed toward the top of the wall while the bottom of the wall is illuminated by light emitted directly from the inner optic 130. The second reflective surface 146 is positioned and shaped to control the reflected light to create the desired light emission pattern. In these and in other embodiments the first reflective surface 144 and second reflective surface 146 and may be made of a white highly reflective material such as injection molded plastic, white optics, PET, MCPET, metal (aluminum, zinc, magnesium) or other reflective material. A reflective coating such as aluminum or silver may be applied to the reflective surfaces via vacuum metallization or sputtering. The reflective surface may also be a formed film, formed aluminum, or the like. The reflective surface may also include a transparent matrix loaded with a high index material such as a silicone with TiO2 particles. The surface finishes of the first reflective surface 144 and second reflective surface 146 may be different.

Because the light emitted from the inner optic 130 is emitted with a large beam angle as described above, a relatively larger percentage of the light is directed onto reflector 140 than in light fixtures where a narrower beam angle is used. As a result the reflector 140 may be more effectively used to control the overall light emission pattern from the light fixture and more light is directed against the second light reflective surface 146 to increase the light projected near the ceiling.

An inner reflector 150 is provided on the inner optic 130 to redirect a portion of the light emitted from the inner optic. The inner reflector 150 reflects a portion of the light that is emitted from the inner optic 130 away from the first reflective surface 144 back toward the second reflective surface 146 to increase the light emitted from the reflective surface toward the top of the wall. The inner reflector 150 also functions to prevent bright spots or glare that may occur due to the relatively large beam angle of the light emitted from lens 160. The inner reflector 150 comprises a partial reflector positioned adjacent the lens 160 to reflect a portion of the light emitted from the inner optic 130 back toward the second reflective surface 146. The inner reflector 150 may be positioned opposite the second reflective surface 146 such that the light reflected from the inner reflector 150 is directed to the second reflective surface 146 where it is used as a component of the wall wash effect. In some embodiments the inner reflector 150 covers approximately 40-60% of lens 160 and in one embodiment covers approximately 50% of the lens 160 to collect and reflect a portion of the light emitted from lens 120. "Covers" as used herein means that the reflector is positioned over the lens 160 and is coextensive with the lens for the stated percentage. In some embodiments the inner reflector 150 extends for approximately 160-200 degrees of the inner optic 130 and in one embodiment extends for approximately 180 degrees of the inner optic 130. As illustrated the inner optic 130 and lens 160 are formed as circles in end view as shown, for example, in FIG. 6; however, even where the inner optic and lens are in end view shaped as other than a circle, such as rectilinear, faceted or the like, the inner reflector 150 may be considered to extend as described above from a point in the center of the lens. The inner reflector 150 may be centered on second reflective surface 146 such that light reflected from reflective surface 152 is projected evenly on the second reflective surface.

The reflective surface 152 may have any suitable shape to collect a portion of the light emitted from the inner optic and reflect it against the second reflective surface 146. In the illustrated embodiment the reflective surface 152 of the inner reflector 150 is a partial dome reflector. The reflective surface 152 may also have a semi-spherical, parabolic, conical, truncated cone, truncated dome, semispherical, faceted or the like shape to achieve the desired light collection and to direct the light onto the second reflective surface 146. In these and in other embodiments the reflective surface 152 and may be made of a white highly reflective material such as injection molded plastic, white optics, PET, MCPET, metal (aluminum, zinc, magnesium) or other reflective material. A reflective coating such as aluminum or silver may be applied to the reflective surface 152. The reflective surface 152 may also be a formed film, formed aluminum, or the like. The reflective surface 152 may also include a transparent matrix loaded with a high index material such as a silicone with TiO2 particles.

In the illustrated embodiment the reflector 150 is made of molded white plastic and is formed integrally with a retention ring 158 that forms a snap-fit connection with the inner optic. Specifically, ring 158 includes a plurality of deformable locking members 159 that engage a lip 136 of the inner optic to secure the reflector 150 to the inner optic 120. A key 153 may engage a mating lock 137 on the reflector 132 to properly orient the inner reflector 150 relative to the second reflective surface 146. Other mounting mechanisms for mounting the inner reflector 150 to the inner optic 130 may also be used.

The inner reflector 150 is also positioned to prevent glare from the light fixture. Because the lens 160 emits light with a relatively large beam angle, a significant portion of the light is emitted generally laterally. In other words without the inner reflector 150 the cut off angle for the lamp would be relatively large. Thus, without the inner reflector 150 a significant portion of the light emitted from the inner optic would be directed laterally against, and be reflected off of, the first reflective surface 144, opposite to the second reflective surface 146. In a typical use of the light fixture where the light fixture is positioned adjacent a wall, this light would be reflected away from the wall and into the room. As will be understood, with a large cut off angle a person looking toward the light fixture would experience glare at a distance laterally spaced from the light fixture. The inner reflector 150 acts as a shield to decrease the amount of light reaching the first reflective surface 144, opposite to the second reflective surface 146, that would otherwise be reflected back into the room. As a result, a person will not experience undesirable glare.

Because the inner reflector is intended to decrease glare, in some embodiments the outside surface 155 of the inner reflector 150 may be coated with a non-reflective coating. For example the outside surface 155 may be covered with a black paint, black film or the like.

The light fixture described above with reference to FIGS. 1-10 is particularly suited for use in lighting fixtures where the depth of the reflector 144 is relatively shallow as compared to its diameter because in a shallow reflector the direct light component tends to be much stronger than the reflected light component. The use of the inner reflector and wide beam angle diffusive lens increases the strength of the reflected light component and decreases the strength of the direct light component to balance the two light components and create a soft transition between the two light components. While the light fixture as described above has particular usefulness with relatively shallow reflectors the light fixture has applicability in any light fixture where the balancing and mixing of the direct and reflected light components is applicable.

Figure 11:
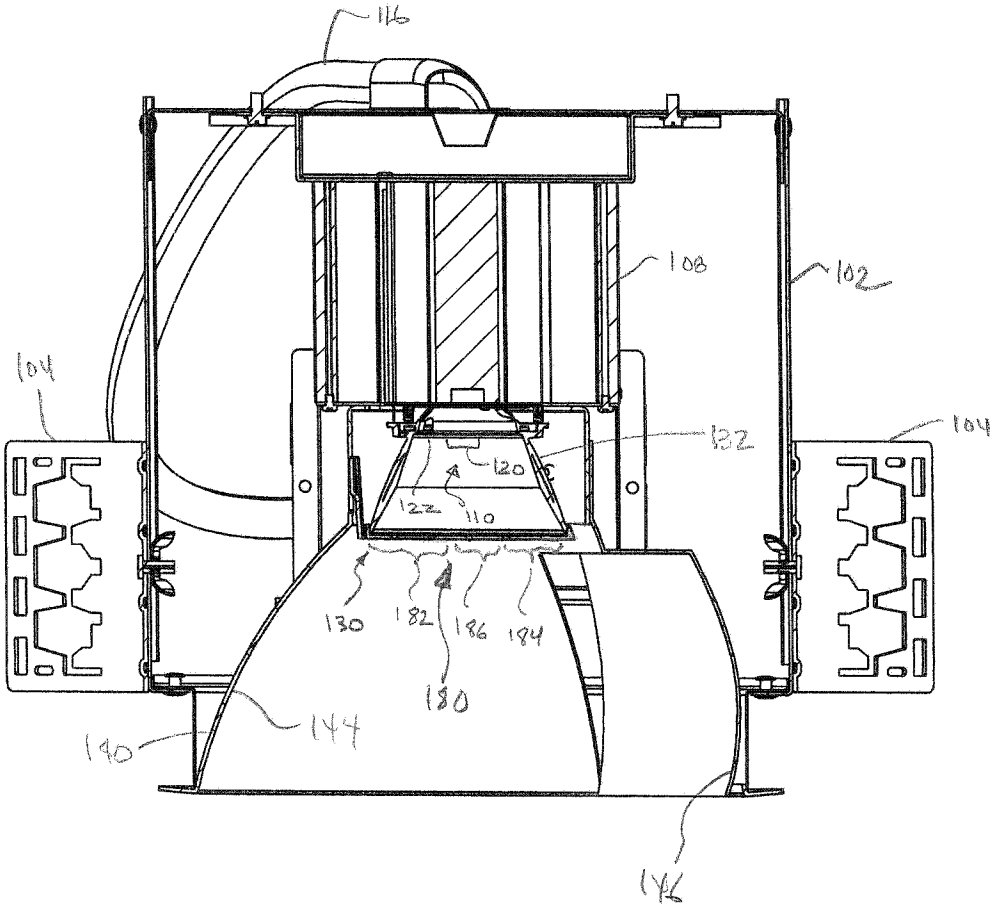
FIG. 11 is a section view similar to FIG. 3 of another embodiment of the invention.
Figure 13:
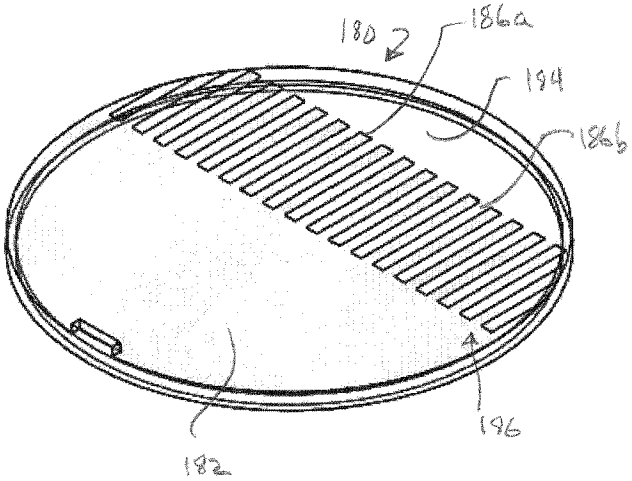
FIG. 13 is a perspective view of the lens of FIG. 12.
Figure 12:
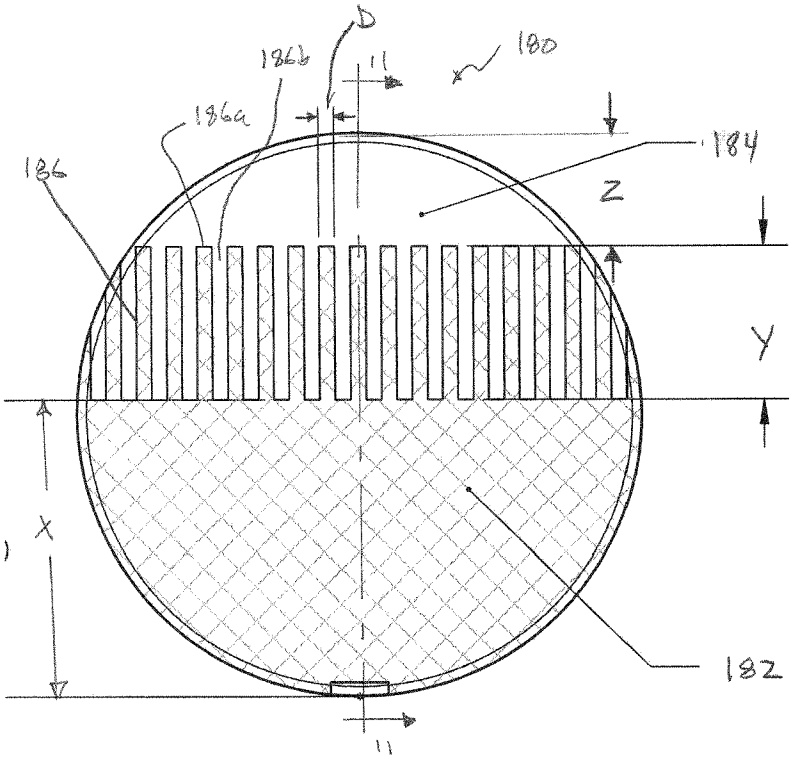
FIG. 12 is a plan view of another embodiment of a lens usable in the lighting fixture of FIG. 11.

Another embodiment of the light fixture of the invention is shown in FIG. 11. The light fixture of FIG. 11 is similar to the light fixture of FIGS. 1-7 except that the lens 160 is replaced by lens 180 (shown in FIGS. 12 and 13) and the inner reflector 150 is removed. Referring to FIGS. 12 and 13, the lens 180 has a first diffusive portion 182, a second diffusive portion 184 and a transition area 186 between the first diffusive portion 182 and the second diffusive portion 184. The first diffusive portion 182 is more diffusive than the second diffusive portion 184. In one embodiment the lens is formed of ABS PC thermoplastic and the diffusive surface is formed by sandblasting or by molding the texture into the lens. The transition area 186 is formed by interdigitating less diffusive areas of lens **186*a* with more diffusive areas of lens 186*b*. The less diffusive areas of lens 186*a* and the more diffusive areas of the lens 1886*b* extend as elongated members or fingers that alternate with one another. In one embodiment the first diffusive portion 182 extends for approximately 50-55% of the diameter of the lens (X), the transition area 186 extends for approximately 25-30% of the diameter of the lens (Y), and the less diffusive portion extends for approximately 15-25% of the diameter of the lens (Z). Each of the interdigitated areas 186*a* and 186*b* may have a width (D) of approximately 2.5-3% of the diameter of the lens. While the fingers 186*a* and 186*b* are shown as rectangular areas these areas may have other shapes. The transition area 186 may also be formed by texturing the transition area to create a gradual change in diffusiveness between the first diffusive portion 182 and the second diffusive portion 184**; however, such a configuration may be more difficult to manufacture.

Lens 180 is disposed in the inner optic such that the second diffusive portion 184 is disposed adjacent the second reflective surface 146 and the first diffusive portion 182 is disposed away from the second reflective surface 146. In the section view of FIG. 11 the view of lens 180 is taken along line 11-11 of FIG. 12. The lens 180 is arranged such that the second diffusive portion 184 projects light primarily on the second reflective surface 146 and the first diffusive portion 182 reflects light primarily on the first reflective surface 144. In this manner the more diffused light is projected towards the bottom of the wall by the first reflective surface 142, the less diffused light is projected against the second reflective surface 146 and reflected to the top of the wall and the light from the transition area 186 creates a smooth transition on the wall between the upper and lower light components. Lens 180 may be used advantageously in lighting fixtures where the depth of the reflector 144 is relatively deep. In some embodiments the lens 180 may be used with the lighting fixture described with respect to FIGS. 1-7 where the inner reflector is used with the lens 180.

In some embodiments a wireless communications module may be provided in the LED lighting fixture for receiving, and/or transmitting a wireless signal between the lighting device and remote input/output devices and/or between lighting devices. The wireless communications module and related smart technologies may be used in any of the embodiments of the lighting fixtures as described herein. The wireless communications module may convert the radio wave to an electronic signal that may be delivered to the LED electronics for controlling operation of the lighting device. The wireless communications module may also be used to transmit a wireless signal from the lighting device to other lighting devices or to remote input/output devices. In various embodiments described herein various smart technologies may be incorporated in the lamps as described in the following applications "Solid State Lighting Switches and Fixtures Providing Selectively Linked Dimming and Color Control and Methods of Operating," application Ser. No. 13/295,609, filed Nov. 14, 2011, which is incorporated by reference herein in its entirety; "Master/Slave Arrangement for Lighting Fixture Modules," application Ser. No. 13/782,096, filed Mar. 1, 2013, which is incorporated by reference herein in its entirety; "Lighting Fixture for Automated Grouping," application Ser. No. 13/782,022, filed Mar. 1, 2013, which is incorporated by reference herein in its entirety; "Multi-Agent Intelligent Lighting System," application Ser. No. 13/782,040, filed Mar. 1, 2013, which is incorporated by reference herein in its entirety; "Routing Table Improvements for Wireless Lighting Networks," application Ser. No. 13/782,053, filed Mar. 1, 2013, which is incorporated by reference herein in its entirety; "Commissioning Device for Multi-Node Sensor and Control Networks," application Ser. No. 13/782,068, filed Mar. 1, 2013, which is incorporated by reference herein in its entirety; "Wireless Network Initialization for Lighting Systems," application Ser. No. 13/782,078, filed Mar. 1, 2013, which is incorporated by reference herein in its entirety; "Commissioning for a Lighting Network," application Ser. No. 13/782,131, filed Mar. 1, 2013, which is incorporated by reference herein in its entirety; "Ambient Light Monitoring in a Lighting Fixture," application Ser. No. 13/838,398, filed Mar. 15, 2013, which is incorporated by reference herein in its entirety; "System, Devices and Methods for Controlling One or More Lights," application Ser. No. 14/052,336, filed Oct. 10, 2013, which is incorporated by reference herein in its entirety; and "Enhanced Network Lighting," Application No. 61/932,058, filed Jan. 27, 2014, which is incorporated by reference herein in its entirety; and "Lighting Device with Operation Responsive to Geospatial Position" application Ser. No. 14/669,739, filed Mar. 26, 2015, which is incorporated by reference herein in its entirety. Additionally, any of the luminaire embodiments described herein can include the smart lighting control technologies disclosed in U.S. Provisional Application Ser. No. 62/292,528, titled "Distributed Lighting Network", filed on Feb. 8, 2016 and assigned to the same assignee as the present application, the entirety of this application being incorporated herein by reference.

The various parts of an LED fixture according to example embodiments of the invention can be made of any of various materials. Heatsinks can be made of metal or heat conductive plastic, as can the various portions of the housings for the components of a fixture. A lighting device according to embodiments of the invention or portions of such a lighting device can be assembled using varied fastening methods and mechanisms for interconnecting the various parts. For example, in some embodiments locking tabs and mating receptacles may be used to join various components together in a snap-fit connection. In some embodiments, combinations of fasteners such as tabs, latches or other suitable fastening arrangements and combinations of fasteners can be used which would not require adhesives or screws. In other embodiments, adhesives, screws, bolts, or other fasteners may be used to fasten together the various components.

In some embodiments, the driver module is included in the electronics housing as shown in the various embodiments described herein. The housing may include the power supply or driver and form all or a portion of the electrical path between the mains and the LEDs. The housing may also include only part of the power supply circuitry while some smaller components reside with the LED assembly. Suitable power supplies and drivers are described in U.S. patent application Ser. No. 13/462,388 filed on May 2, 2012 and titled "Driver Circuits for Dimmable Solid State Lighting Apparatus" which is incorporated herein by reference in its entirety; U.S. patent application Ser. No. 12/775,842 filed on May 7, 2010 and titled "AC Driven Solid State Lighting Apparatus with LED String Including Switched Segments" which is incorporated herein by reference in its entirety; U.S. patent application Ser. No. 13/192,755 filed Jul. 28, 2011 titled "Solid State Lighting Apparatus and Methods of Using Integrated Driver Circuitry" which is incorporated herein by reference in its entirety; U.S. patent application Ser. No. 13/339,974 filed Dec. 29, 2011 titled "Solid-State Lighting Apparatus and Methods Using Parallel-Connected Segment Bypass Circuits" which is incorporated herein by reference in its entirety; U.S. patent application Ser. No. 13/235,103 filed Sep. 16, 2011 titled "Solid-State Lighting Apparatus and Methods Using Energy Storage" which is incorporated herein by reference in its entirety; U.S. patent application Ser. No. 13/360,145 filed Jan. 27, 2012 titled "Solid State Lighting Apparatus and Methods of Forming" which is incorporated herein by reference in its entirety; U.S. patent application Ser. No. 13/338,095 filed Dec. 27, 2011 titled "Solid-State Lighting Apparatus Including an Energy Storage Module for Applying Power to a Light Source Element During Low Power Intervals and Methods of Operating the Same" which is incorporated herein by reference in its entirety; U.S. patent application Ser. No. 13/338,076 filed Dec. 27, 2011 titled "Solid-State Lighting Apparatus Including Current Diversion Controlled by Lighting Device Bias States and Current Limiting Using a Passive Electrical Component" which is incorporated herein by reference in its entirety; and U.S. patent application Ser. No. 13/405,891 filed Feb. 27, 2012 titled "Solid-State Lighting Apparatus and Methods Using Energy Storage" which is incorporated herein by reference in its entirety.

Any of the embodiments disclosed herein may include power or driver circuitry having a buck regulator, a boost regulator, a buck-boost regulator, a fly-back converter, a SEPIC power supply or the like and/or multiple stage power converter employing the like, and may comprise a driver circuit as disclosed in U.S. patent application Ser. No. 14/291,829, filed May 30, 2014, entitled "High Efficiency Driver Circuit with Fast Response" by Hu et al. or U.S. patent application Ser. No. 14/292,001, filed May 30, 2014, entitled "SEPIC Driver Circuit with Low Input Current Ripple" by Hu et al. incorporated by reference herein. The circuit may further be used with light control circuitry that controls color temperature of any of the embodiments disclosed herein, such as disclosed in U.S. patent application Ser. No. 14/292,286, filed May 30, 2014, entitled "Lighting Fixture Providing Variable CCT" by Pope et al. incorporated by reference herein. Additionally, any of the embodiments described herein can include driver circuitry disclosed in U.S. patent application Ser. No. 15/018,375, titled Solid State Light Fixtures Having Ultra-Low Dimming Capabilities and Related Driver Circuits and Methods, filed on Feb. 8, 2016 and assigned to the same assignee as the present application, the entirety of this application being incorporated herein by reference.

Although specific embodiments have been illustrated and described herein, those of ordinary skill in the art appreciate that any arrangement which is calculated to achieve the same purpose may be substituted for the specific embodiments shown and that the invention has other applications in other environments. This application is intended to cover any adaptations or variations of the present invention. The following claims are in no way intended to limit the scope of the invention to the specific embodiments described herein.

The invention claimed is:

1. A LED light fixture comprising:

at least one LED operable to emit light when energized through an electrical path;

an inner optic positioned to receive the light, the inner optic comprising a lens for emitting the light from the inner optic;

a reflector positioned to receive the light emitted from the inner optic; and an inner reflector positioned to asymmetrically reflect the light from the inner optic relative to the reflector, wherein the inner optic comprises a mixing chamber.

2. The LED lighting device of claim 1 wherein the lens is diffusive.

3. The LED lighting device of claim 1 wherein the lens emits light with a beam angle of between 30 and 65 degrees.

4. The LED lighting device of claim 1 wherein the reflector comprises a first reflective surface and a second reflective surface.

5. The LED lighting device of claim 4 wherein the second reflective surface reflects light asymmetrically relative to the reflector.

6. The LED lighting device of claim 4 wherein the inner reflector is positioned opposite the second reflective surface.

7. The LED lighting device of claim 1 wherein the inner reflector is positioned at least partially over the lens.

8. The LED lighting device of claim 7 wherein the inner reflector covers approximately 40-60% of the lens.

9. The LED lighting device of claim 4 wherein the inner reflector comprises a reflective surface that faces the lens.

10. The LED lighting device of claim 9 wherein the inner reflector comprises a non-reflective outside surface.

11. The LED lighting device of claim 9 wherein the inner reflector reflects light to the second reflective surface.

12. The LED lighting device of claim 1 wherein a keyed connection orients the inner reflector relative to the reflector.

13. The LED lighting device of claim 4 wherein the inner reflector reflects light toward the second reflective surface.

14. The LED lighting device of claim 4 wherein the inner reflector reflects light asymmetrically relative to the reflector.

15. The LED lighting device of claim 4 wherein the inner reflector reflects light asymmetrically toward a bottom of an adjacent surface and the reflector reflects light asymmetrically toward a top of the adjacent surface.

16. A LED light fixture comprising:

at least one LED operable to emit light when energized through an electrical path;

an inner optic positioned to receive the light, the inner optic comprising a lens for emitting the light from the inner optic generally in a first direction along a longitudinal axis of the light fixture;

an outer reflector comprising a first reflective surface and a second reflective surface positioned to receive the light emitted from the inner optic where the second reflective surface is arranged opposite to the first reflective surface transversely to the longitudinal axis of the light fixture such that light is reflected asymmetrically from the outer reflector; and an inner reflector positioned inside of and surrounded by the outer reflector, wherein the inner reflector reflects a portion of the light emitted from the inner optic and redirects the portion of the light in a second direction that is substantially transverse to the longitudinal axis of the light fixture toward the second reflective surface and away from the first reflective surface such that the portion of the light emitted from the inner optic reflects off of the second reflective surface.

17. The LED lighting device of claim 16 wherein the lens emits light with a beam angle of between 30 and 65 degrees.

18. The LED lighting device of claim 16 wherein the inner reflector is positioned opposite the second reflective surface.

19. The LED lighting device of claim 16 wherein the inner reflector is positioned at least partially over the lens.

20. The LED lighting device of claim 19 wherein the inner reflector covers approximately 40-60% of the lens.

21. A LED light fixture comprising:

at least one LED operable to emit light when powered through an electrical path;

an inner optic positioned to receive the light, the inner optic comprising a reflector and a lens for emitting the light from the inner optic, the lens comprising a first diffusive portion, a second diffusive portion and a transition portion between the first diffusive portion and the second diffusive portion, the first diffusive portion being more diffusive than the second diffusive portion and the transition portion being less diffusive than the first diffusive portion and more diffusive than the second diffusive portion wherein the transition portion comprises interdigitated diffusive portions;

a reflector positioned to receive the light emitted from the inner optic.

22. The LED lighting device of claim 21 wherein the lens emits light asymmetrically.

23. A LED light fixture comprising:

at least one LED operable to emit light when powered through an electrical path;

an inner optic positioned to receive the light, the inner optic comprising a lens for emitting the light from the inner optic, the lens comprising a first diffusive portion, a second diffusive portion and a transition portion between the first diffusive portion and the second portion, the first diffusive portion being more diffusive than the second diffusive portion and the transition portion being less diffusive than the first diffusive portion and more diffusive than the second diffusive portion wherein the transition portion comprises interdigitated diffusive portions;

a reflector positioned to receive the light emitted from the inner optic; and an inner reflector positioned to asymmetrically reflect the light from the inner optic relative to the reflector.

24. A LED light fixture comprising:

at least one LED operable to emit light when energized through an electrical path;

an inner optic positioned to receive the light, the inner optic comprising a reflective surface and a lens for emitting the light from the inner optic with a beam angle of between approximately 30 and 65 degrees, the at least one LED being positioned to a first side of the lens;

a reflector positioned to receive the light emitted from the inner optic; and an inner reflector positioned to asymmetrically reflect the light from the inner optic relative to the reflector, wherein the inner reflector is positioned to a second side of the lens opposite the first side of the lens to receive a portion of the light transmitted through the lens, wherein the inner reflector is positioned at least partially over the lens and covers approximately 40 to 60% of the lens such that the light is reflected directionally to the reflector.

25. The LED light fixture of claim 21, wherein the reflector comprises a first reflective surface and a second reflective surface.

* * * * *